US010072910B2

(12) United States Patent
Kim

(10) Patent No.: US 10,072,910 B2
(45) Date of Patent: Sep. 11, 2018

(54) THERMAL TARGET BOARD

(71) Applicant: CONET SYS CO., LTD, Incheon (KR)

(72) Inventor: Duk Ki Kim, Gyeonggi-do (KR)

(73) Assignee: CONET SYS CO., LTD., Incheon (KR)

( * ) Notice: Subject to any disclaimer, the term of this patent is extended or adjusted under 35 U.S.C. 154(b) by 0 days.

(21) Appl. No.: 15/117,204

(22) PCT Filed: Oct. 10, 2014

(86) PCT No.: PCT/KR2014/009536
§ 371 (c)(1),
(2) Date: Aug. 7, 2016

(87) PCT Pub. No.: WO2015/119353
PCT Pub. Date: Aug. 13, 2015

(65) Prior Publication Data

US 2016/0370154 A1 Dec. 22, 2016

(30) Foreign Application Priority Data

Feb. 7, 2014 (KR) ..... 10-2014-0014413
Aug. 18, 2014 (KR) ..... 10-2014-0106990

(51) Int. Cl.
*F41J 2/02* (2006.01)

(52) U.S. Cl.
CPC ..... *F41J 2/02* (2013.01)

(58) Field of Classification Search
CPC F41J 2/02; H05B 2203/013; H05B 2203/011; H05B 2203/009
USPC ..... 273/348.1; 219/213, 536
See application file for complete search history.

(56) References Cited

U.S. PATENT DOCUMENTS 1,375,863 A * 4/1921 Stanton ..... H05B 3/342 219/212
3,999,040 A * 12/1976 Ellis ..... H01B 1/00 106/425
4,260,160 A * 4/1981 Ejnell ..... F41J 2/02 250/503.1
4,405,132 A * 9/1983 Thalmann ..... F41J 2/02 273/348.1
4,659,089 A * 4/1987 Rosa ..... F41J 2/02 250/495.1

(Continued)

FOREIGN PATENT DOCUMENTS

KR 20-0304206 Y1 2/2003
KR 20-0354154 Y1 6/2004

(Continued)

OTHER PUBLICATIONS

International Search Report for PCT/KR2014/009536.

*Primary Examiner* — Mark Graham
(74) *Attorney, Agent, or Firm* — The PL Law Group, PLLC

(57) ABSTRACT

A thermal target board includes heating paint coated to one surface of a fabric in a rectangular shape and dried, and electrode wires installed parallel to two sides facing each other on the surface on which the heating paint is coated and each of which has an end extending outward from an edge of the fabric. The thermal target board is driven by direct current, and is capable of implementing a stable heat generation with low manufacturing costs by using a heating paint including a bar-shaped carbon conductor.

4 Claims, 10 Drawing Sheets

(56) References Cited

U.S. PATENT DOCUMENTS

| | | | | |
|---|---|---|---|---|
| 6,315,294 | B1 * | 11/2001 | Belleville | F41J 2/02 273/348.1 |
| 2008/0296842 | A1 * | 12/2008 | Novak | F41J 2/02 273/348.1 |
| 2009/0194942 | A1 * | 8/2009 | Hodge | F41J 2/02 273/348.1 |
| 2010/0000981 | A1 * | 1/2010 | Diemer | H05B 3/146 219/202 |
| 2012/0218633 | A1 * | 8/2012 | Cincotti | F41J 1/01 359/463 |
| 2012/0279953 | A1 * | 11/2012 | Augustine | A61G 13/12 219/217 |
| 2013/0220994 | A1 * | 8/2013 | Hanada | H05B 3/845 219/553 |

FOREIGN PATENT DOCUMENTS

| | | | |
|---|---|---|---|
| KR | 10-2005-0032711 | | 4/2005 |
| KR | 10-2005-0032711 | A | 4/2005 |
| KR | 10-0825407 | B1 | 4/2008 |
| KR | 10-2013-0062080 | A | 6/2013 |

* cited by examiner

THERMAL TARGET BOARD

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/KR2014/009536, filed Oct. 10, 2014, which claims priority to the benefit of Korean Patent Application No. 10-2014-0014413 filed on Feb. 7, 2014 and 10-2014-0106990 filed on Aug. 18, 2014 in the Korean Intellectual Property Office, the entire contents of which are incorporated herein by reference.

TECHNICAL FIELD

The present invention relates to a thermal target board which is driven by using direct current and is economical. Particularly, the present invention relates to a thermal target board capable of implementing stable heat generation with low manufacturing costs by using heating paint including a carbon conductor.

BACKGROUND ART

Target boards represented papers on which targets are drawn for personal firing practices in the past, but are being expanded as concepts including panels and sheets used in firing practices of cannons and missiles as well as personal usages.

Generally, the target boards might be used only in the daytime and not be used in the nighttime unless a separate lighting system is provided. However, since the supply of infrared goggles etc. is expanded in modern wars, battles in which light is not provided are unavoidable.

In this case, night firing practices are conducted with thermal target boards which mimic heat generated from human bodies. However, conventional target boards realizing the heat generated from the human bodies with heating wires may not function as the target boards any more when the heating wires are cut off by a ballistic trajectory.

To solve the above-described problem, in Korean Utility Model Registration No. 354154, the applicant of the present invention improved a target board so as to be continually used also after being penetrated by a ballistic trajectory by using heat generated by using an aluminum thin plate.

However, a problem in which the aluminum thin plate is economically infeasible due to the cost thereof has still existed.

SUMMARY

The present invention is proposed to solve the above-described problem, and an objective of the present invention is to provide a thermal target board which is manufactured by using heating paint including a carbon conductor to implement stable heat generation with low manufacturing costs.

In order to achieve above object, a thermal target board according to the present invention includes:

a heating paint coated on one surface of a fabric in a rectangular shape and dried; and electrode wires installed in a direction parallel to two sides facing each other on the surface on which the heating paint is coated and having an end extending outward from an edge of the fabric.

Also, the electrode wire may be fixed by being stitched with thread.

Also, adhesive may be disposed between the electrode wire and the heating paint.

Also, a portion or entire of the electrode wire is immersed in the heating paint before hardening the heating paint, and then the heating paint may be hardened.

Also, one to three electrode wires may be installed on each of sides.

Also, the ends of the electrode wires extending on the one side may be gathered to form one terminal.

Also, a film layer may be additionally attached to a surface of the heating paint, a surface of the fabric, or surfaces of the heating paint and the fabric in the thermal target board.

Also, the fabric or the film layer may have a shape in which a central portion is high, and two side portions are lower than the central portion.

Also, a colored film may be additionally attached to the film layer attached to the surface of the heating paint in the thermal target board.

Also, the colored film may have a black color.

Also, a direct current (DC) of 10 to 30 V or an alternating current (AC) of 100 to 250 V, and preferably, the DC of 11 to 25 V or the AC of 100 to 240 V may be applied to the terminal.

Also, a distance between the electrode wires installed in a direction parallel to each other may be 25 cm to 45 cm, and preferably, 33 cm to 40 cm.

Also, a temperature of the thermal target board is 30° C. to 40° C. when current is applied to the thermal target board.

Also, the heating paint may include a binder including polyurethane and a heater including a carbon conductor, and preferably, a nano carbon conductor.

The thermal target board of the present invention may be driven by the direct current (DC) and thus be used in the outdoor practice in which the electricity is not supplied. Also, the stable heat generation with the low manufacturing costs may be implemented by using the carbon conductor having a relatively low price, instead of using the aluminum thin plate having a high price. Particularly, the electrode wire may be fixed to the fabric by using the thread to prevent the electrode wire from being separated from the heating paint or prevent the contact failure from occurring after the thermal target board is folded or used for a long time. As a result, the heat may be uniformly generated on the entire surface of the target board.

DETAILED DESCRIPTION

Hereinafter, a preferred embodiment of the present invention will be described in more detail. Also, several specific details such as specific constituents are described in the following description. However, they are provided only to help more general understanding of the present invention. It will be obvious to a person skilled in the art that the invention can be made without such the specific details. Also, in the following description of the present invention, detailed descriptions related to well-known functions or configurations will be ruled out in order not to unnecessarily obscure subject matters of the present invention.

Figure 1:
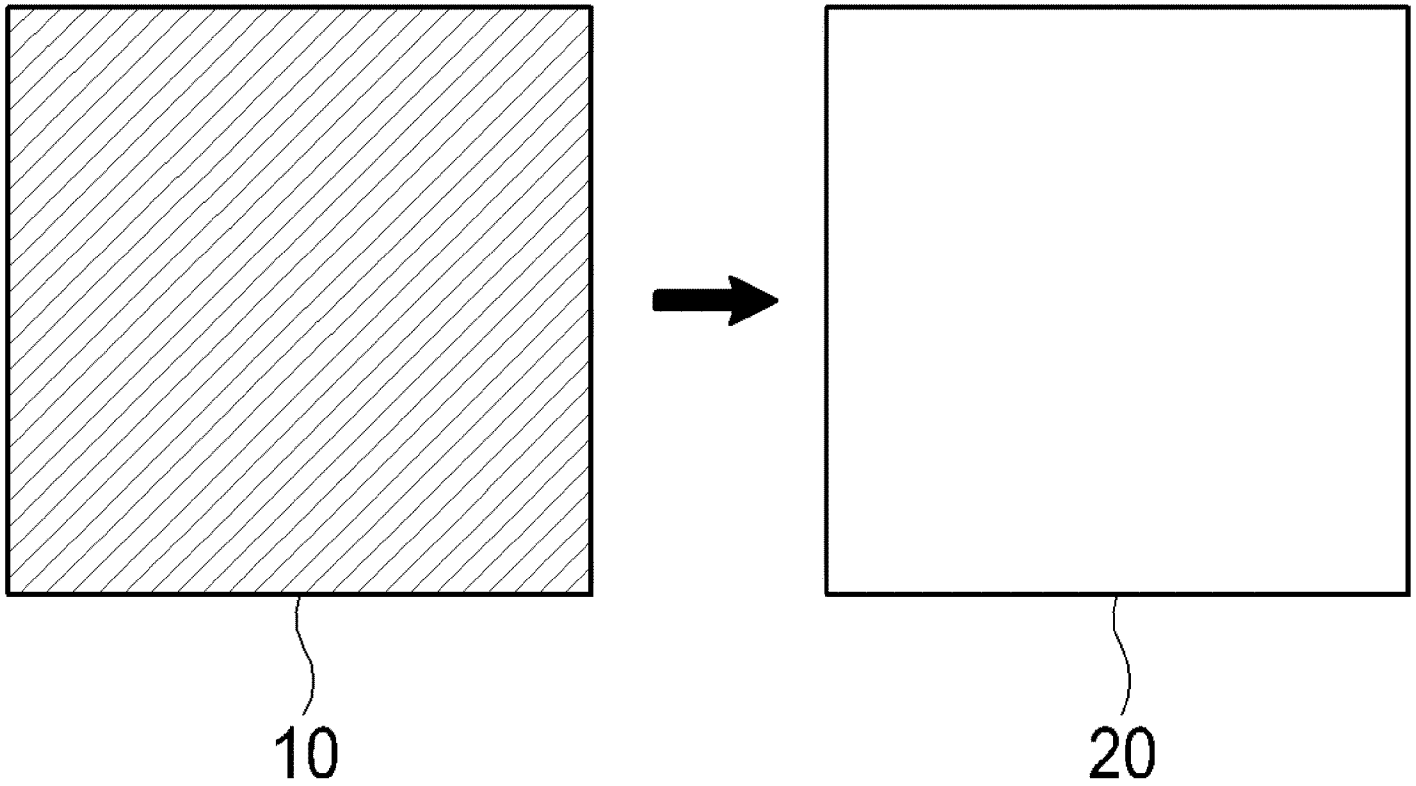
FIG. 1 is a view of a fabric and a state in which a heating paint is coated to the fabric.
Figure 2:
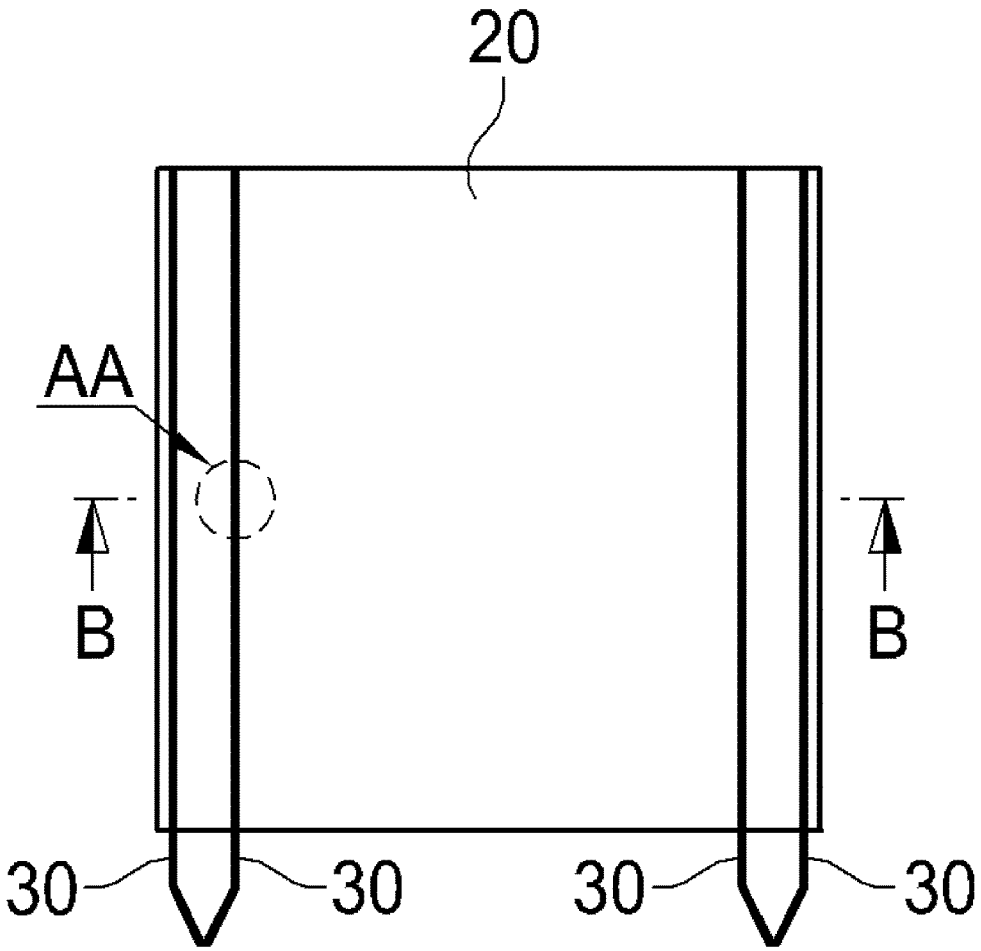
FIG. 2 is a view illustrating a state in which an electrode wire is installed on the fabric.

A thermal target board according to the present invention includes a heating paint 20 illustrated at the right side of FIG. 1, which is coated in a rectangular shape on one surface of a fabric 10 illustrated at the left side of FIG. 1 and an electrode wire 30 of FIG. 2, which is installed parallel to two sides facing each other on the surface on which the heating paint 20 is coated and has an end extending outward from an edge of the fabric 10.

The electrode wire 30 allows the heating paint 20 to generate heat when current is applied to the electrode wire 30. One to three electrode wires may be installed on one side of the rectangular shape, and thus total two to six electrode wires may be installed on the two sides facing each other. FIG. 2 is a view illustrating an embodiment in which two electrode wires are respectively installed on one side. Since two or three electrode wires are installed on the one side as illustrated in FIG. 2, the current may be stably supplied to allow the heating paint 20 to uniformly generate heat even if one electrode wire 30 is broken.

Figure 3:
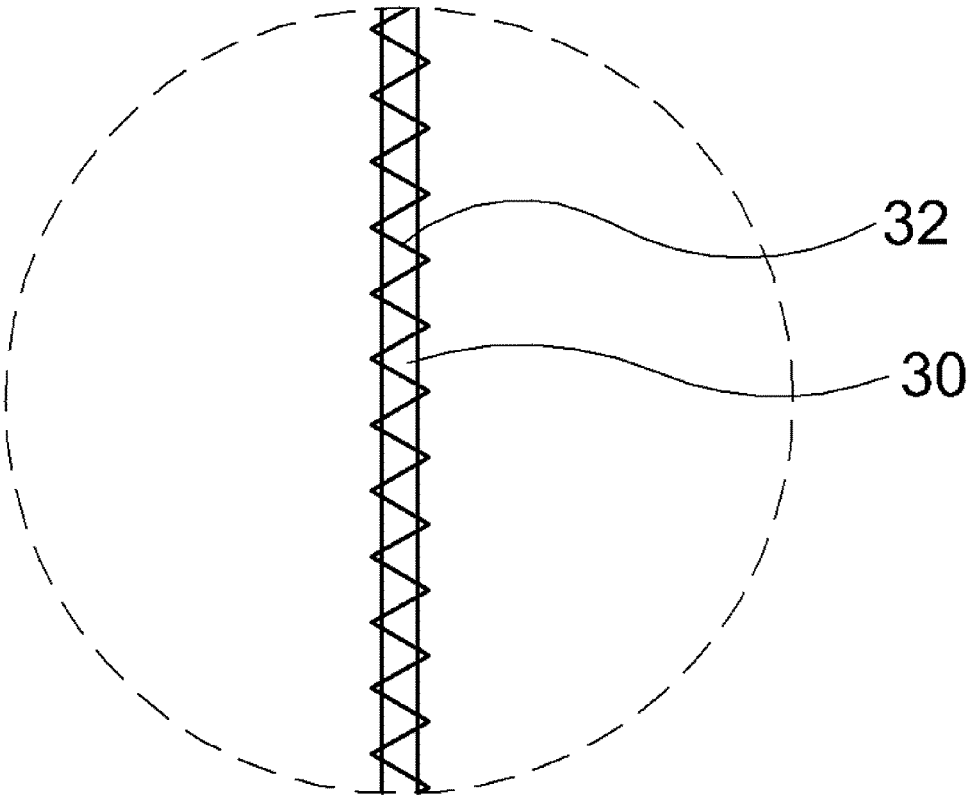
FIG. 3 is a partial enlarged view of a portion AA in FIG. 2.
Figure 4:
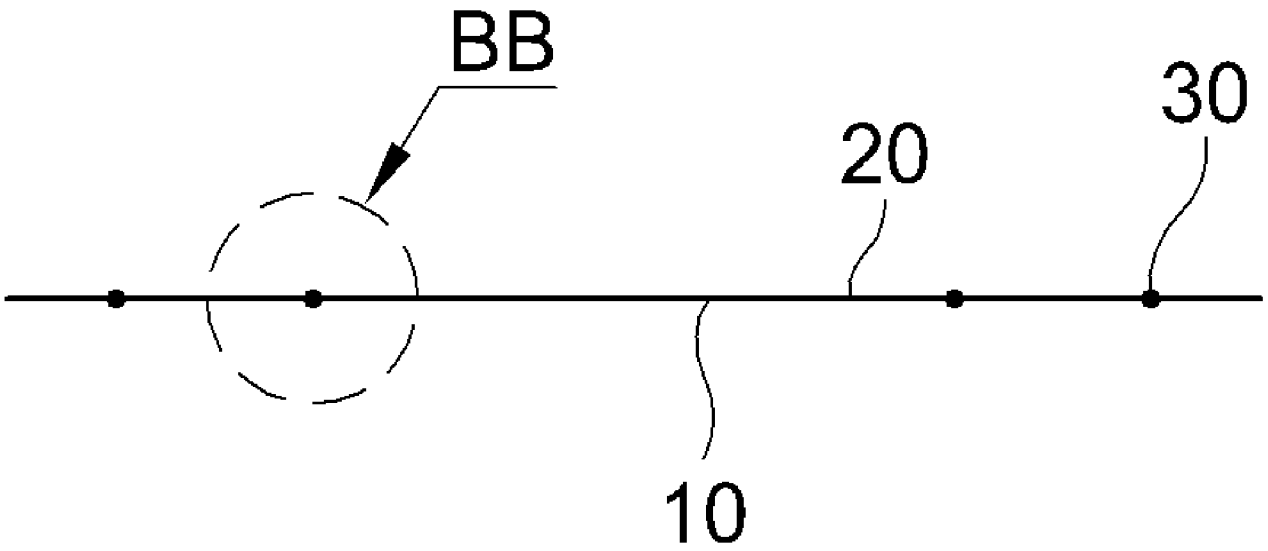
FIG. 4 is a side view of a portion taken along line B-B of FIG. 2.
Figure 5:
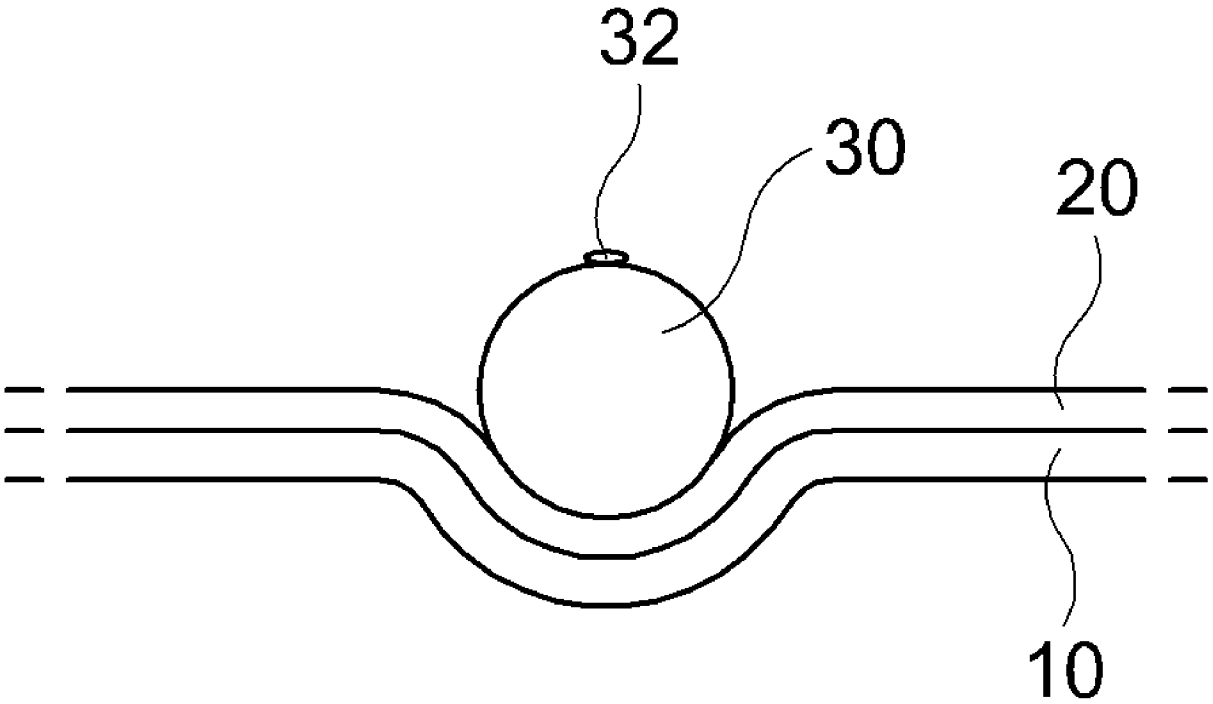
FIG. 5 is a partial enlarged view of a portion BB in FIG. 4.

It is preferable that the electrode wire 30 is fixed to the fabric 10 on which the heating paint 20 is coated by using thread 32 as illustrated in FIGS. 3 and 5. For example, the electrode wire 30 may be fixed by being stitched with the thread 32 in a zigzag shape as illustrated FIG. 3. Thus, although the thermal target board is folded or is used for a long time, since the electrode wire 20 is not separated from the heating paint 20, the heat may be stably generated from an entire surface of the target board.

Figure 6:
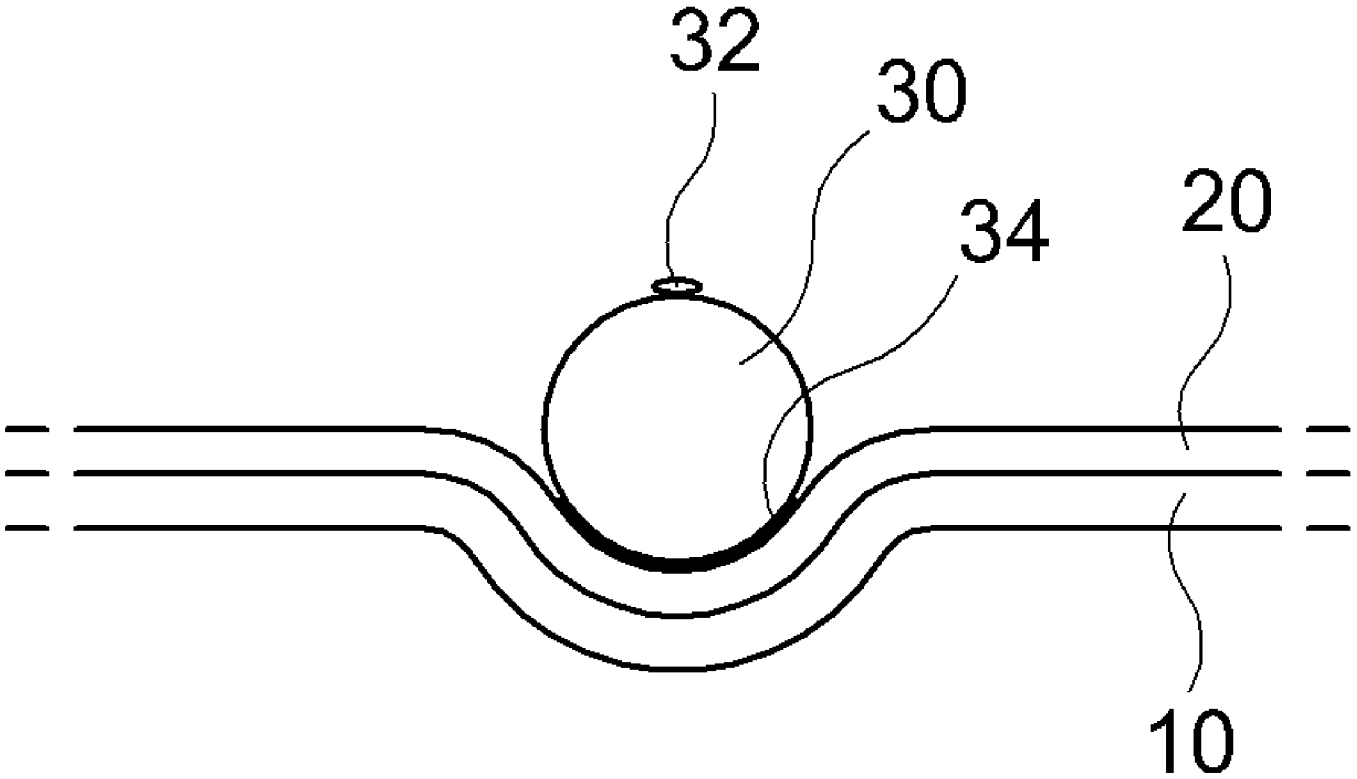
FIG. 6 is another partial enlarged view of a portion BB in FIG. 4.
Figure 7:
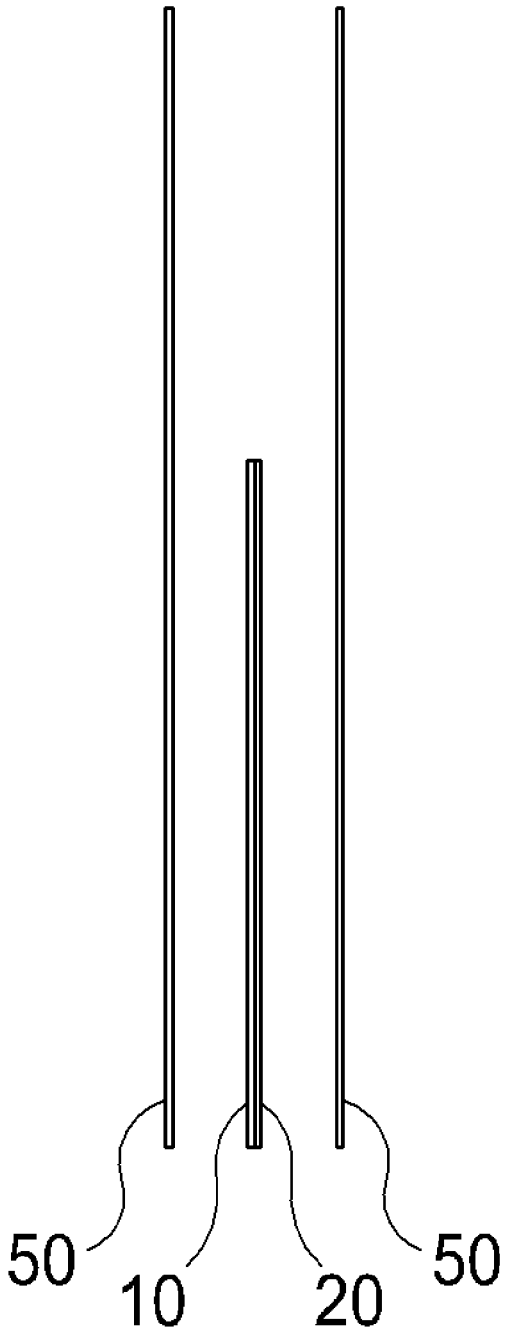
FIG. 7 is a side sectional view illustrating a state in which a film layer is attached to the fabric where the electrode wire is installed.

Furthermore, in order to firmly ensure coupling between the electrode wire 30 and the heating paint 20, it is preferable that an adhesive 34 is disposed therebetween as illustrated in FIG. 6.

In addition, it is preferable that the electrode wire is allowed to contact the heating paint 20 before the heating paint 20 coated to the fabric 10 is fully hardened after being coated to the fabric 10, and then the heating paint 20 is hardened in a state in which a portion or the whole of the electrode wire 30 is immersed in the heating paint 20, thereby preventing the electrode wire 30 and the heating paint 20 from being separated from each other.

Figure 8:
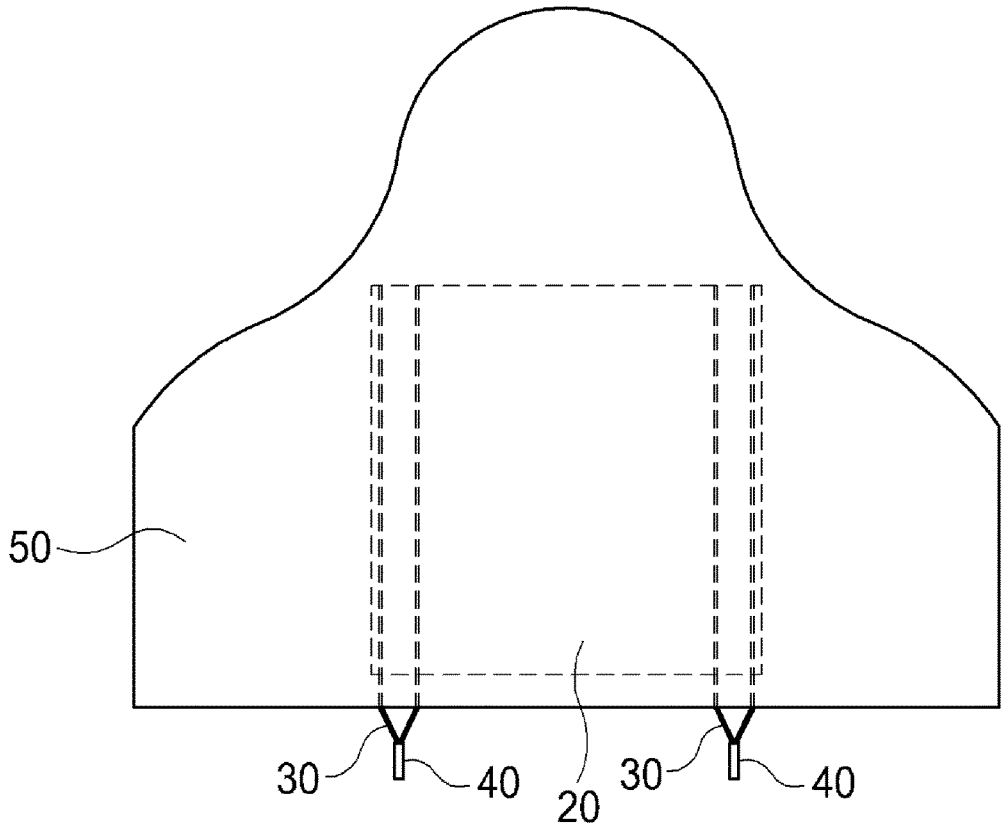
FIGS. 8 and 9 are front views illustrating the state of FIG. 7, in which terminalization is completed.
Figure 9:
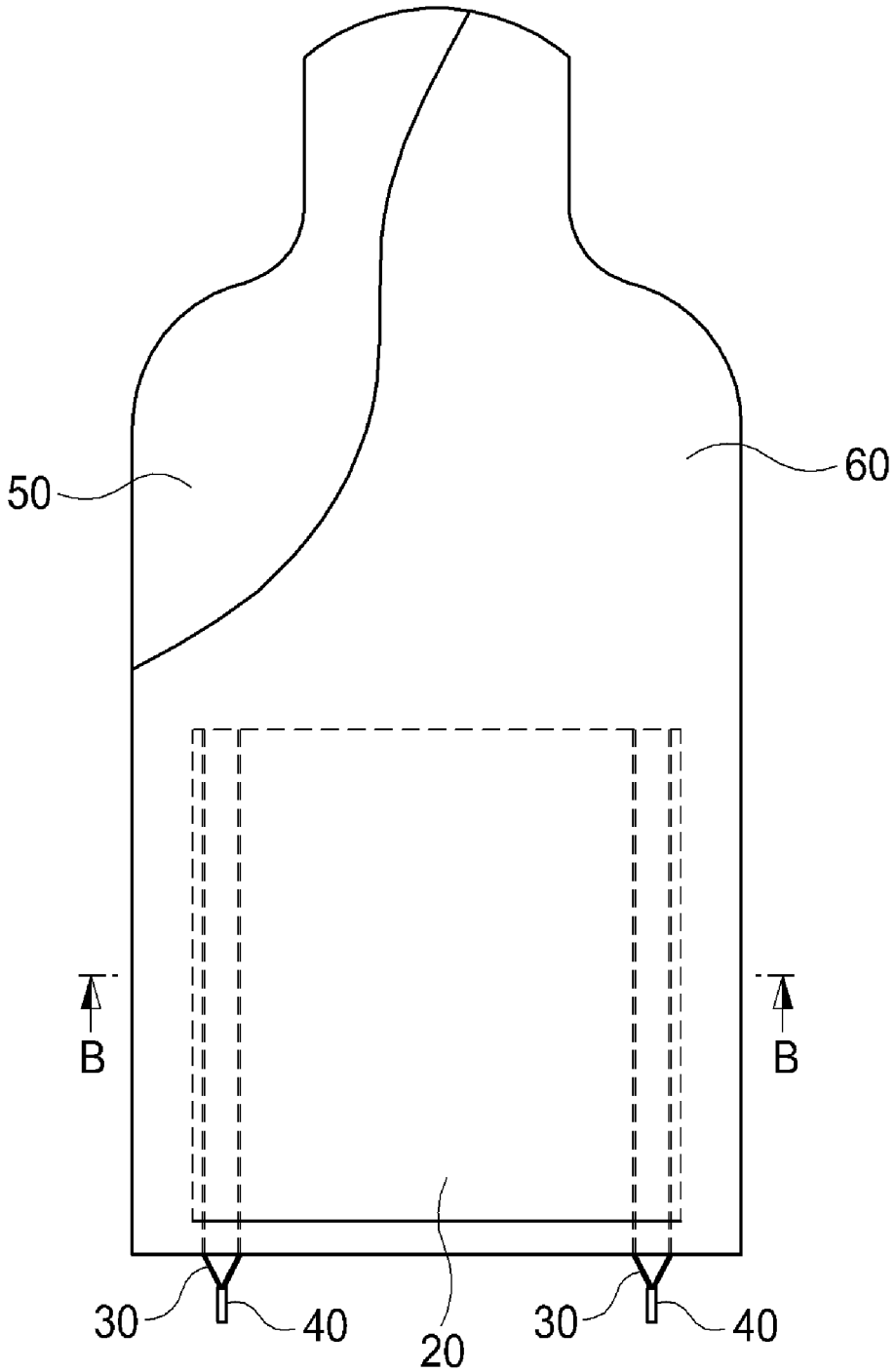
Figure 10:
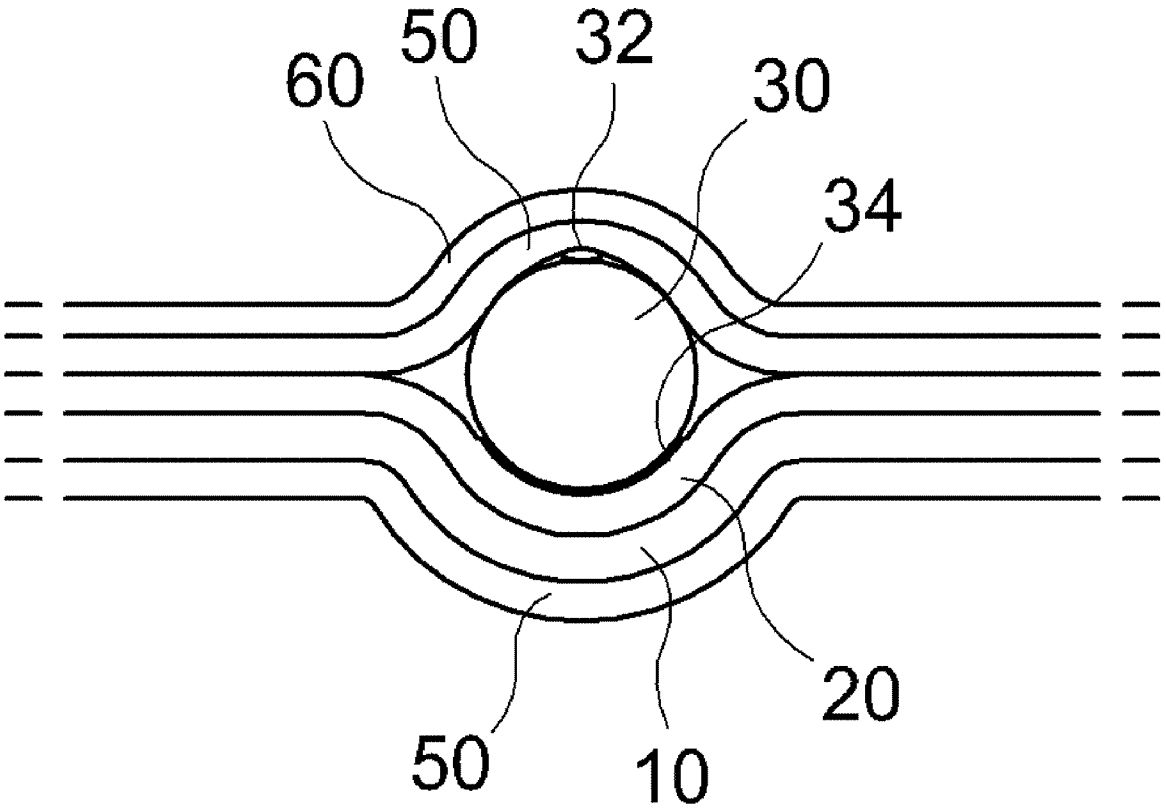
FIG. 10 is a partial enlarged view of a side surface taken along line B-B of FIG. 9.

In the electrode wires 30 installed as described above, the ends of the electrode wires 30 extending outward from the edge of the fabric 10 are gathered to form one terminal 40 as illustrated in FIG. 8 or 9. As a result, total two terminals 40 may be formed in the one thermal target board.

Also, in the thermal target board, it is preferable that a film layer 50 is additionally attached to a surface of the heating paint, a surface of the fabric, or the surfaces of the heating paint and the fabric as illustrated in FIGS. 7 to 10 to protect the heating paint 20, from which the heat is actually generated, against the rainstorm and the like.

Furthermore, it is preferable that a colored film 60 is additionally attached to the film layer 50 attached to the surface of the heating paint 20 to easily identify an impact point, like general target boards. For example, the colored film 60 may have a black color.

In this case, the fabric 10 or the film layer 50 may have a general rectangular shape. Alternatively, the fabric 10 or the film layer 50 may have a shape in which a central portion is high, and two side portions are lower than the central portion to mimic an upper half of the human body as illustrated in FIGS. 8 and 9.

Direct current (DC) of 10 to 30 V or alternating current (AC) of 100 to 250 V may be applied to the terminal disposed on the thermal target board manufactured according to the present invention. Preferably, the DC of 11 to 25 V or the AC of 100 to 240 V, e.g., the DC of 12 to 24 V or the AC of 110 to 220 V may be applied. Particularly, the thermal target board of the present invention may allow firing practices to be conducted by supplying the DC voltage in a remote area or the outside in which electricity is not supplied.

Particularly, it is preferable that the heat is generated at a temperature similar to that of the human body so as to be identified by an infrared goggle and the like. The thermal target board of the present invention has a feature in which the thermal target board generates heat having temperature of 30° C. to 40° C. when the current within the above-described voltage range is applied.

Furthermore, in the thermal target board of the present invention, the heat generation temperature of the thermal target board may be controlled by adjusting a distance between the electrode wires 30 installed parallel to each other. For example, the thermal target board generates heat having a temperature of 30° C. to 40° C. at, preferably, a distance 25 cm to 45 cm, more preferably, a distance of 33 cm to 40 cm.

The heating paint 20 of the present invention may include a binder including polyurethane and a heater including a carbon conductor.

An aluminum thin plate for generating heat in conventional thermal target board may significantly deteriorate price-competiveness due to its high price. The present invention solves an economical problem by using the carbon conductor having a low price instead of the aluminum thin plate. Particularly, the heating paint 20 including the carbon conductor is applied, and the electrode wires 20 are installed to be spaced apart from each other. Then, when the current is applied, the whole of the heating paint 20 is heated by resistance. The present invention utilizes the above-described principle.

As the carbon conductor used in the present invention, a carbon particle having a general globular shape may be used because the carbon conductor is not limited in shape. However, a bar-shaped carbon conductor having a bar shape may be preferably used to control conductivity. Furthermore, it is more preferable to use a carbon particle having a nano-scale size such as a carbon nanotube and graphene.

Also, as the binder constituting the heating paint 20, any synthetic polymer without limitation may be used if the synthetic polymer is generally used as paint. For example, a polyurethane resin may be used as the binder.

According to the present invention, the heating paint 20 is prepared by adding the carbon conductor together with a solvent to the binder resin. If necessary, a dispersing agent and/or an antifoaming agent may be added to prepare the heating paint 20.

For example, the heating paint 20 may have compositions of 25 to 55 parts by weight of a separate solvent, 12 to 30 parts by weight of the carbon conductor, 0.02 to 0.04 parts by weight of the dispersing agent, and 0.01 to 0.02 parts by weight of the antifoaming agent per 100 parts by weight of a mixture of 80 wt % to 90 wt % of the solvent and 10 wt % to 20 wt % of the polyurethane.

Hereinafter, an example of the present invention will be described.

EXAMPLE 50 g of methylethylketone (Maruzen Petrochemical, Japan) and 35 g of acetone (Kumho Petrochemical, Korea) are added to 15 g of an epoxy resin (Kukdo Chemical, Korea) and stirred to prepare an epoxy resin solution. 25 g of methylethylketone (Maruzen Petrochemical, Japan) and 15 g of the carbon conductor (8 g of S160 and 7 g of V-SGA), 0.02 g of Triton X-100 (Dow Chemical, US) and 0.01 g of BYK-024 (BYK Chemie, Germany) are put into 65 g of the epoxy resin solution and stirred and milled to prepare the heating paint used in the thermal target board of the present invention.

Although the preferred embodiment of the present invention is described above, the present invention is not limited to the above specific embodiment. Therefore, it is obvious to a person skilled in the art that various modifications may be made without departing from subject matters of the present invention. Therefore, the scope of the present invention is not intended to be limited to the specific embodiment described above, but should be defined by the appended claims and equivalents of the claims.

The invention claimed is:

1. A thermal target board comprising:

a fabric having a first surface and a second surface opposite to the first surface, the fabric having edges comprised of a first edge, a second edge opposite to the first edge, a third edge and a fourth edge opposite to the third edge;

heating paint coated directly only to the first surface of the fabric;

electrode wires attached directly to the heating paint with adhesive, the electrode wires comprising a first pair of electrode wires installed along the first edge of the fabric, and a second pair of electrode wires installed along the second edge of the fabric, the first pair of electrode wires having a first end extending outward from the third edge of the fabric, the second pair of electrode wires having a second end extending outward from the third edge of the fabric, wherein there is no electrode wire between the first pair of electrode wires and the second pair of electrode wires;

a thread with which each of the electrode wires are fixed to the fabric by being stitched;

a pair of terminals comprising a first terminal formed of the first end of the first pair of electrode wires and a second terminal formed of the second end of the second pair of electrode wires;

a first film layer formed directly on the heating paint on which the electrode wires are fixed by being stitched with the thread to cover the heating paint, the electrode wires and the thread;

a black colored film is additionally attached to a surface of the first film layer opposite to a surface of the first film layer on which the thread, the electrode wires and the heating paint are formed; and a second film layer formed directly on the second surface of the fabric;

wherein the thermal target board is free from an aluminum plate; and the heating paint coated to one surface of the fabric is prepared by a process comprised of:

coating the heating paint composition on said one surface of the fabric;

before the heating paint is fully hardened, immersing a portion or the whole of the electrode wires in the heating paint composition;

after the immersing, fully hardening the heating paint composition to prepare the heating paint coated to said one surface of the fabric.

2. The thermal target board of claim 1, wherein direct current (DC) of 10 to 30 V or alternating current (AC) of 100 to 250 V is applied to the terminals.

3. The thermal target board of claim 1, wherein, when current is applied to the thermal target board, the thermal target board has a temperature of 30° C. to 40° C.

4. The thermal target board of claim 1, wherein the heating paint comprises a binder comprising polyurethane and a heater comprising a carbon conductor.

* * * * *